United States Patent [19]

Silverberg et al.

[11] 4,397,459

[45] Aug. 9, 1983

[54] APPARATUS FOR DETECTING THE FLOTATION LEVEL IN AN AIR SUPPORTED SHEET SEPARATING AND FEEDING DEVICE

[75] Inventors: Morton Silverberg, Penfield; John M. Browne, Victor; Dale W. Young, Chili, all of N.Y.

[73] Assignee: Xerox Corporation, Stamford, Conn.

[21] Appl. No.: 244,437

[22] Filed: Mar. 16, 1981

[51] Int. Cl.[3] ..... B65H 3/12; B65H 3/48

[52] U.S. Cl. ..... 271/94; 271/98; 271/105; 271/166

[58] Field of Search ..... 271/3.1, 98, 97, 99, 271/105, 165, 166, 96, 94, 108, 35, 34

[56] References Cited

U.S. PATENT DOCUMENTS

| | | | |
|---|---|---|---|
| 2,819,076 | 1/1958 | Wendt et al. | 271/34 UX |
| 3,618,932 | 11/1971 | Moreland et al. | 271/98 |
| 3,945,633 | 3/1976 | Knopp | 271/97 X |
| 3,947,018 | 3/1976 | Stange | 271/99 |
| 4,132,400 | 1/1979 | Naramore | 271/221 |
| 4,134,580 | 1/1979 | Duzinskas et al. | 271/35 X |
| 4,165,132 | 8/1979 | Hassan et al. | 406/10 |
| 4,269,406 | 5/1981 | Hamlin | 271/3.1 X |
| 4,299,381 | 11/1981 | Smith | 271/98 X |

OTHER PUBLICATIONS

Roller, D. C., "Recirculating Automatic Document Feeder," *IBM Tech. Disc. Bull.*, vol. 22, No. 6, Nov. 1979, pp. 2228–2229.

Wenthe, S. "Air Adjustment-Automatic", *Xerox Disc. Journal*, vol. 5, No. 4, Jul./Aug. 1980, p. 383.

*Primary Examiner*—Bruce H. Stoner, Jr.

*Attorney, Agent, or Firm*—H. Fleischer; J. E. Beck; R. Zibelli

[57] ABSTRACT

An apparatus in which sheets are separated and fed, in seriatim, from a stack with a flow of pressurized fluid being directed between the stack and support thereof. The pressurized fluid produces a gap between the stack and support which is detected. The pressure of the fluid is controlled in response to the detected gap.

17 Claims, 8 Drawing Figures

APPARATUS FOR DETECTING THE FLOTATION LEVEL IN AN AIR SUPPORTED SHEET SEPARATING AND FEEDING DEVICE

This invention relates generally to an apparatus for separating and feeding sheets from a stack thereof. An apparatus of this type is frequently employed in electrophotographic printing machines.

As electrophotographic printing machines become increasingly rapid, automatic handling of original documents becomes highly desirable. Today, electrophotographic printing machines have the capability of both duplex and simplex. This increases the complexity of the document handling system which must be capable of handling both types of original documents. The reproduction of both sides of a duplex original document may be on separate copy sheets or onto both sides of the same copy sheet. The document handling system should be capable of recirculating either simplex or duplex sheets. Similarly, the copy sheet handling system must also be capable of recirculating the copy sheet to provide for both simplex or duplex reproduction thereon. A number of document handling systems are currently capable of performing these tasks. These documents handling units must operate flawlessly to virtually eliminate the risk of damaging the original document and minimize machine shutdowns due to jams or misfeeds. Generally, the greatest number of problems occur at initial separation of the individual documents from the stack.

Inasmuch as the documents must be handled gently but positively to assure separation without damage through a number of cycles, a number of different types of separators have been suggested. For example, friction rolls or belts are used for fairly positive document feeding in conjunction with a retard belt, pad or roll to prevent misfeeds. Vacuum separators such as sniffer tubes, rocker type vacuum rolls, or vacuum feed belts have also been employed.

Friction roll retard systems are positive, however, the action of the retard member, as it acts on the printed face may produce smearing or partial erasure of the printed material. Though this may not propose a problem with simplex copying, it does produce a significant problem in duplex copying. Vacuum systems may be employed with air knives for reducing the friction between the stack and the support. However, it is necessary to control the pressure of the flowing air to insure that friction between the stack and the support is minimized. Various approaches have been devised to improve document handling systems. The following disclosures appear to be relevant:

U.S. Pat. No. 4,324,395
Patentee: Silverberg
Issued: Apr. 13, 1982

U.S. Pat. No. 4,313,599
Patentee: Lohr
Issued: Feb. 2, 1982

U.S. Pat. No. 4,275,877
Patentee: Silverberg
Issued: June 30, 1981

U.S. Ser. No. 81,595, now abandoned
Applicant: Silverberg
Filed: Oct. 3, 1979

U.S. Pat. No. 4,284,270
Patentee: Silverberg
Issued: Aug. 18, 1981

U.S. Pat. No. 4,269,406
Patentee: Hamlin
Issued: May 26, 1981

U.S. Pat. No. 4,270,746
Patentee: Hamlin
Issued: June 2, 1981

U.S. Pat. No. 4,305,576
Patentee: Hamlin
Issued: Dec. 15, 1981

U.S. Pat. No. 4,336,928
Patentee: Smith et al.
Issued: June 29, 1982

U.S. Pat. No. 4,299,381
Patentee: Smith
Issued: Nov. 10, 1981

U.S. Pat. No. 4,336,929
Patentee: Hanzlik
Issued: June 29, 1982

The pertinent portions of the foregoing disclosures may be briefly summarized as follows:

Silverberg ('395) discloses an automatic document handler which feeds documents, in seriatim, to the imaging station of a reproducing machine. The document handler includes a vacuum-belt document corrugation friction feeder, and air knife to assure positive feeding of successive document to the imaging station.

In Lohr, the document handler includes an air flotation stack tray having striations formed therein to encourage laminar air flow thereover for improved air flotation of the stack.

Silverberg ('877) describes an automatic document handler having a vacuum belt document separator and a multiple orifice air knife. The document tray has a "U" shaped pocket to assure positive document feeding.

Silverberg ('595) discloses a document handler including a vacuum belt document separator applying a vacuum to a sheet being fed for a selected period of time prior to operation of the feed belt advancing each document to the copier imaging station.

Silverberg ('270) describes a vacuum belt document separator, air knife and document tray for an automatic document handler. The tray has a "U" shaped pocket therein.

Hamlin ('406) discloses a document handler in which a common blower provides sub-atmospheric air for a sheet separator and pressurized air for the air knife. A cyclically operated valve associated with the blower controls the air flow.

Hamlin ('746) describes a document handler in which an air knife is directed at a 21° angle downwardly toward the lead edge of the stack bottom sheet.

Hamlin ('576) describes a document handler including a tray having a "U" shaped pocket with ramps formed on both sides thereof.

Smith et al. discloses a document handler having a belt feeder and an air knife. The quantity of air discharged from the air knife is varied in accordance with the number of documents in the document handler.

Smith discloses a bottom sheet feeder utilizing a common blower for furnishing air to an air knife and vacuum feeder. A self-actuating vaccum-pressure bleed valve is interconnected with the blower inlet and outlet to optimize air flow in the system.

Hanzlik describes a sheet feeder in which a plurality of vacuum feed belts are associated with a biased corrugating ramp. The ramp produces a large corrugation in light weight papers while being depressed by heavy weight stiff sheets. This permits the sheet to closely approach the feed belt for acquisition thereby.

Other patents of interest are the following: U.S. Pat. No. 3,618,932 issued to Moreland et al. in 1971; U.S. Pat. No. 3,945,633 issued to Knopp in 1976; U.S. Pat. No. 3,947,018 issued to Stange in 1976; U.S. Pat. No. 4,132,400 issued to Naramore in 1979; U.S. Pat. No. 4,134,580 issued to Duzinskas et al. in 1979; and U.S. Pat. No. 4,165,132 issued to Hassan et al. in 1979. Knopp and Duzinskas et al. describe sensing the height of a stack of sheets and regulating feeding of additional sheets to the stack in response to the detected light. Naramore discloses manifolds having a pyramidal array of holes therein which act as fluid jets. This provides a greater air flow at the bottom of the stack than at the top thereof.

In accordance with the features of the present invention, there is provided an apparatus for separating and feeding sheets, in seriatim, from a stack. The apparatus includes means for supporting the stack of sheets. Means direct a flow of pressurized fluid between the stack and supporting means to reduce friction therebetween. Means move the stack from a first position to a second position and measure the time for the stack to return to the first position from the second position. Means, responsive to the measured time, control the directing means to regulate the pressure of the fluid flowing between the supporting means and the stack.

Other features of the present invention will become apparent as the following description proceeds and upon reference to the drawings, in which.

While the present invention will hereinafter be described in connection with preferred embodiments thereof, it will be understood that it is not intended to limit the invention to these embodiments. On the contrary, it is intended to cover all alternatives, modifications and equivalents as may be included within the spirit and scope of the invention as defined by the appended claims.

Figure 1:
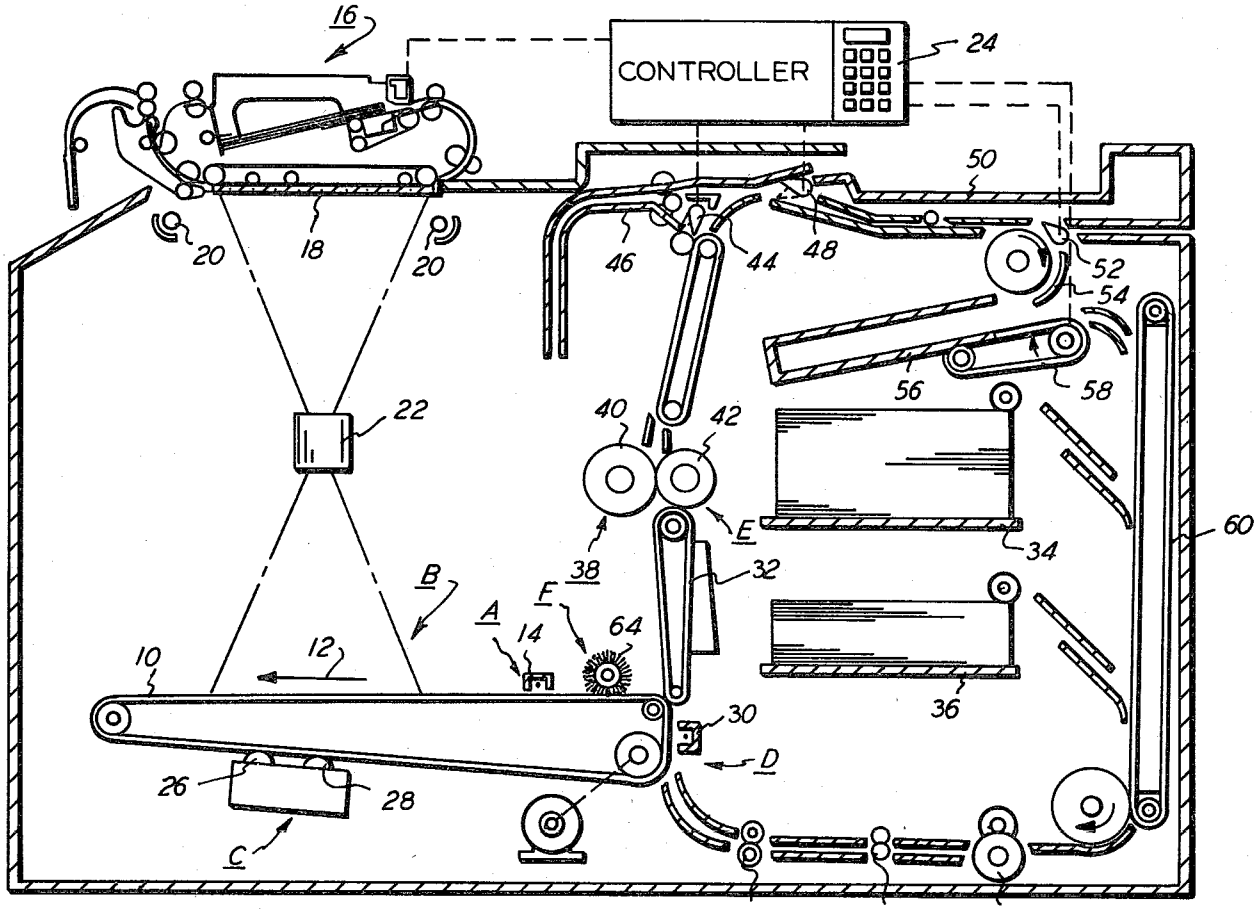
FIG. 1 is a schematic elevational view illustrating an electrophotographic printing machine incorporating the features of the present invention therein.

For a general understanding of the features of the present invention, reference is had to the drawings. In the drawings, like reference numerals have been used throughout to designate identical elements. FIG. 1 schematically depicts the various components of an illustrative electrophotographic printing machine incorporating the sheet separating and feeding apparatus of the present invention therein. It will become evident from the following discussion that the sheet separating and feeding apparatus is equally well suited for use in a wide variety of printing machines, and is not necessarily limited in its application to the particular printing machine shown herein.

Inasmuch as the art of electrophotographic printing is well known, the various processing stations employed in the FIG. 1 printing machine will be shown hereinafter schematically and their operation described briefly with reference thereto.

As shown in FIG. 1, the illustrative electrophotographic printing machine employs a belt 10 having a photoconductive surface thereon. Preferably, the photoconductive surface is made from a selenium alloy. Belt 10 moves in the direction of arrow 12 to advance successive portions of the photoconductive surface through the various processing stations disposed about the path of movement thereof.

Initially, a portion of the photoconductive surface passes through charging station A. At charging station A, a corona generating device, indicated generally by the reference numeral 14, charges the photoconductive surface to a relatively high substantially uniform potential.

Next, the charged portion of the photoconductive surface is advanced through imaging station B. At imaging station B, a document handling unit, indicated generally by the reference numeral 16, is positioned over platen 18 of the printing machine. Document handing unit 16 sequentially feeds documents from a stack of documents placed by the operator facedown in a normal forward collated order in a document stacking and holding tray. The documents are fed, in seriatim, to platen 18. Lamps 20 illuminate the document positioned on transparent platen 18. The light rays reflected from the document are transmitted through lens 22. Lens 22 focuses the light image of the original document onto the charged portion of the photoconductive surface of belt 10 to selectively dissipate the charge thereof. This records an electrostatic latent image on the photoconductive surface which corresponds to the informational areas contained within the original document. Thereafter, belt 10 advances the electrostatic latent image recorded on the photoconductive surface to development station C.

Document handling unit 16 recirculates the documents back to the top of the stack of documents supported on the tray. The document handling unit has switches or other sensors for detecting and counting the individual documents fed from the tray. A sensor indicates the completion of each circulation of the complete document set. The sensor is automatically reset before the next circulation. Document handling unit 16 is adapted to serially sequentially feed the documents, which may be of various sizes and weights of paper or plastic containing information to be copied on one or both sides thereof. A bottom feeder feeds the bottommost document from the stack on the tray. The bottom feeder feeds the bottommost document, on demand by controller 24, from the stack onto platen 18. The side facing platen 18, i.e. the side facing down, is imaged to form the electrostatic latent image thereof on the photoconductive surface of belt 10. After imaging, the next successive original document is advanced to platen 18 by the bottom feeder. Document handling unit 16 is arranged to invert the original document for duplex copying. The detailed structure of document handling unit 16 will be described hereinafter with reference to FIGS. 2 through 8, inclusive.

With continued reference to FIG. 1, the exemplary electrophotographic printing machine will be described in further detail. At development station C, a pair of magnetic brush developer rollers, indicated generally by the reference numerals 26 and 28, advance a developer material into contact with the electrostatic latent image. The latent image attracts toner particles from the carrier granules of the developer material to form a toner powder image on the photoconductive surface of belt 10.

Belt 10 then advances the toner powder image to transfer station D. At transfer station D, a copy sheet is moved into contact with the toner powder image. Transfer station D includes a corona generating device 30 which sprays ions onto the backside of the copy sheet. This attracts the toner powder image from the photoconductive surface of belt 10 to the sheet. After transfer, conveyor 32 advances the sheet to fusing station E.

The copy sheets are fed from a selected one the trays 34 or 36 to transfer station D. After transfer of the toner powder image to the first side of the copy sheet, the sheets are then advanced by vacuum conveyor 32 to fusing station E.

Fusing station E includes a fuser assembly, indicated generally by the reference numeral 38, which permanently affixes the transferred powder image to the copy sheet. Preferably, fuser assembly 38 includes a heat fuser roller 40 and a backup roller 42. The sheet passes between fuser roller 40 and backup roller 42 with the powder image contacting fuser roller 40. In this manner, the powder image is permanently affixed to the copy sheet.

After fusing, the copy sheets are fed to gate 44 which functions as an inverter selector. Depending upon the position of gate 44, the copy sheets will be deflected into a sheet inverter 46 or bypass inverter 46 and be fed directly onto a second decision gate 48. The sheets which bypass inverter 46 turn a 90° corner in the sheet path before reaching gate 48. Gate 48 inverts the sheets into a face up orientation so that the imaged side which has been transferred or fushed is face up. If inverter path 46 is selected, the opposite is true, i.e the last printed side is facedown. The second decision gate 48 either deflects the sheet directly into an output tray 50 or deflects the sheets into a transport path which carries them on without inversion to a third decision gate 52. Gate 52 either passes the sheets directly on without inversion into the output path of the copier, or deflects the sheets onto a duplex inverter roll 54. Roll 54 inverts and stacks sheets to be duplexed in a duplex tray 56 when gate 52 so directs. Duplex tray 56 provides intermediate or buffer storage for those sheets which have been printed on one side and on which an image will be subsequently printed on the side opposed thereto, i.e. the sheets being duplexed. Due to sheet inverting by roll 54, these buffer set sheets are stacked in duplex tray 56 facedown. They are stacked in duplex tray 56 on top of one another in the order in which they are copied.

In order to complete duplex copying, the previously simplexed sheets in tray 56 are fed in seriatim by bottom feeder 58 from tray 56 back to transfer station D for transfer of the toner powder image to the opposed side of the copy sheet. Conveyors 60 and 62 advance the sheet along a path which produces an inversion thereof. However, inasmuch as the bottommost sheet is fed from duplex tray 56, the proper or clean side of the copy sheet is positioned in contact with belt 10 at transfer station D so that the toner powder image thereon is transferred thereto. The duplex sheets are then fed through the same path as the previously simplexed sheets to be stacked in tray 50 for subsequent removal by the printing machine operator.

With continued reference to FIG. 1, invariably after the copy sheet is separated from the photoconductive surface of belt 10, some residual particles remain adhering thereto. These residual particles are removed from the photoconductive surface at cleaning station F. Cleaning station F includes a rotatably mounted fibrous brush 64 in contact with the photoconductive surface of belt 10. The particles are cleaned from the photoconductive surface of belt 10 by the rotation of brush 64 in contact therewith. Subsequent to cleaning, a discharge lamp (not shown) floods the photoconductive surface with light to dissipate any residual electrostatic charge remaining thereon prior to the charging thereof for the next successive imaging cycle.

Controller 24 is preferably a known programmable microprocessor which controls all the machine functions hereinbefore described including the operation of document handling unit 16, the document and copy sheet gates, the feeder drives, etc.. The controller also provides the storage and comparison of counts of the copy sheets, the number of documents being recirculated in the documents set, the number of copy sets selected by the operator through the switches thereon, time delays, jam correction control, etc.. The control of all of the exemplary copy sheet handling systems disclosed hereinbefore may be accomplished by conventionally activating them by control switch inputs from the printing machine console selected by the operator, such as selecting the number of copies, simplex or duplex copying, whether the documents are simplex or duplex, etc.. These signals activate known electrical, solenoid or cam control sheet deflector fingers, or drive motors, or their clutches in the selected steps or sequences. Conventional sheet path sensors or switches may be utilized for counting and keeping track of the position of the documents and copy sheets. Pre-collation copying systems heretofore utilized employed microprocessor control circuitry and connecting switches for counting the number of document sheets as they are recirculated as well as counting the number of completed document sets and controlling the operation of the document handling unit, copy sheet feeders, and inverters, etc.. Exemplary control systems for both document and sheet handling are described in U.S. Pat. No. 4,062,061, issued Dec. 6, 1977 to Batchelor et al.; U.S. Pat. No. 4,123,155, issued Oct. 31, 1978 to Hubert; U.S. Pat. No. 4,125,325, issued Nov. 14, 1978 to Batchelor et al.; and U.S. Pat. No. 4,144,550, issued Mar. 13, 1979 to Donohue et al. The relevant portions of the foregoing patents are hereby incorporated into the present application where appropriate.

It is believed that the foregoing description is sufficient for purposes of the present application to illustrate the general operation of an electrophotographic printing machine incorporating the features of the present invention therein.

Referring now to the specific subject matter of the present invention, the general operation of document handling unit 16 will be described hereinafter with reference to FIGS. 2 through 8, inclusive.

Figure 2:
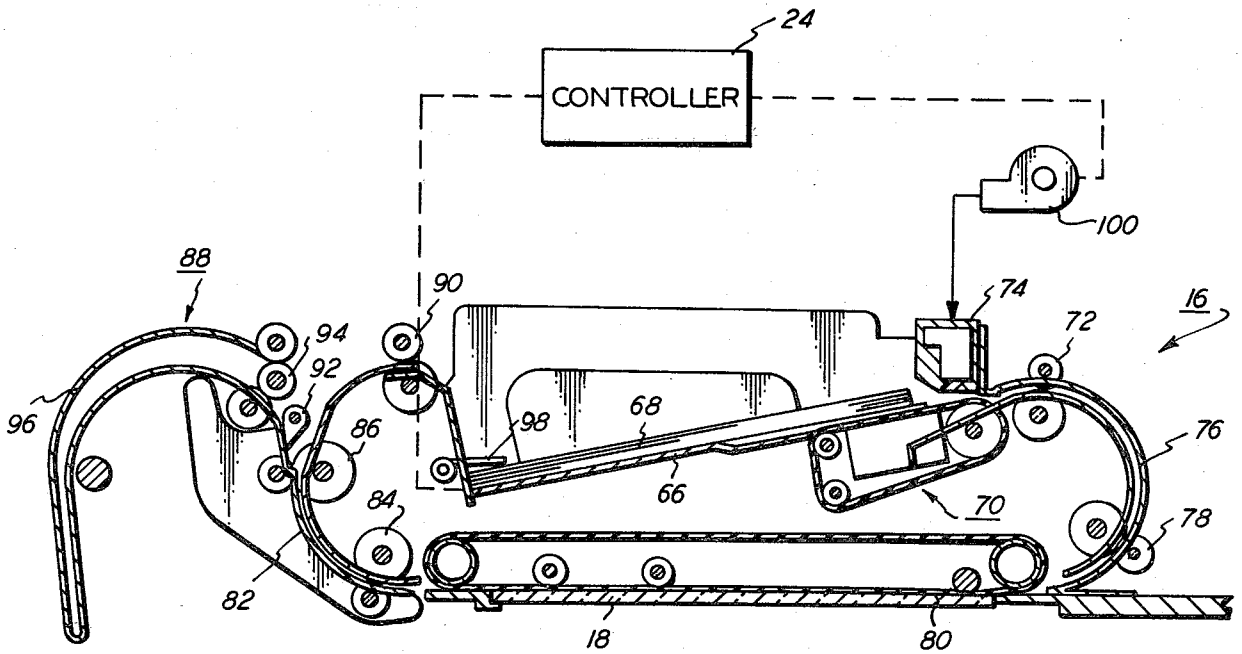
FIG. 2 is an elevational view, partially in section, of a document handling unit used in the FIG. 1 printing machine.

Turning now to FIG. 2, document handling unit 16 is positioned above exposure platen 18. The document handling unit is provided with a document tray 66, adapted to support a stack of documents 68 face up thereon. A vacuum belt corrugating feeder 70 is located below the document tray for acquiring and corrugating the bottom document in the stack and forwarding the document to take away roll pairs 72 after an air knife 74 has had time to separate the bottommost sheet from stack 68. The bottommost sheet is then fed by take away roll pair 72 through document guide 76 to feed roll pair 78 and under platen belt 80 onto platen 18. After imaging, the original document is fed from platen 18 by belt 80 into guide 82 and feed roll pairs 84 and 86 and to an inverter mechanism indicated generally by reference numeral 88, or back to the document stack through feed roll pair 90. Decision gate 92 is provided to divert the document either to the inverter or to feed roll pair 90. The inverter comprises a three roll arrangement 94 and a closed inverter pocket 96. If the document is to be inverted, it is fed through the lower two rolls of the three roll inverter into the pocket. When the trail edge of the document clears the nip of the lower two rolls in the three roll inverter, the stiffness of the sheet will cause the trail edge to straighten up into the nip of the upper two rollers of the inverter at which time it will be fed into roll pair 90 and back onto the document stack. The inverter pocket illustrated is sized such that when the leading edge of the document contacts the end of the pocket, the document will buckle slightly within the upper portion of the pocket 96, the buckle thereby providing the required force to feed the trailing edge of the document into the upper roll pair of the inverter rolls for feeding the sheet toward roll pair 90.

Document handling unit 16 is also provided with a sheet separator finger 98 as is well known in the art to separate the documents to be fed from those documents returned to tray 66. Upon removal of the last document from beneath finger 98, the finger drops through a slot provided in the tray, suitable sensors are provided to sense that the last document in the set has been removed from the tray, and the finger is rotated in a clockwise direction to again rest on the top of the stack of documents prior to subsequent recirculation of the document set.

Blower 100 furnishes pressurized fluid, i.e. air, to air knife 74. Controller 24 receives a signal indicative of the friction, as measured by the spacing or gap between the bottommost sheet of the stack and tray 66. In response to this signal, controller 24 regulates blower 100 to control the pressure of the air being furnished to air knife 74. After the air pressure furnished to air knife 74 is at the desired level, air knife 74 directs the flow air between the bottommost sheet and the remainder of the sheets of the stack. This reduces friction between the bottommost sheet and the stack to facilitate separation therebetween.

Figure 3:
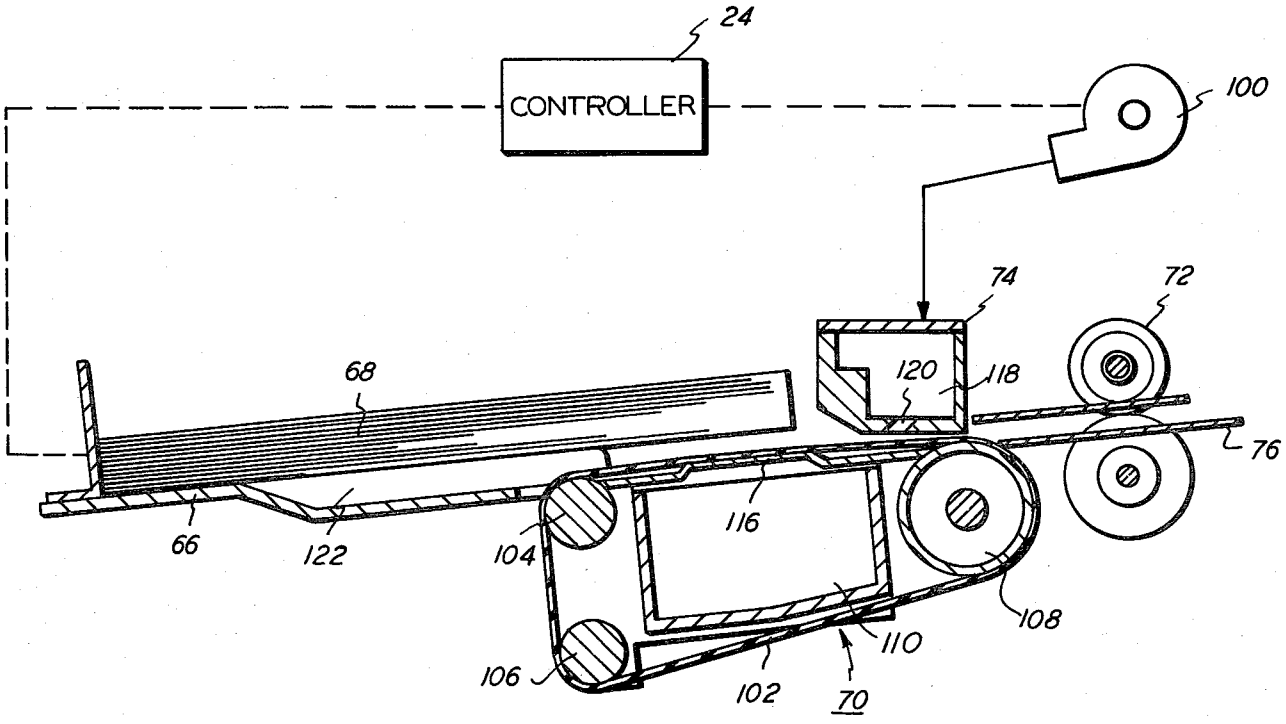
FIG. 3 is an enlarged, sectional elevational view illustrating the sheet separating and feeding portion of the FIG. 2 document handling unit.
Figure 6:
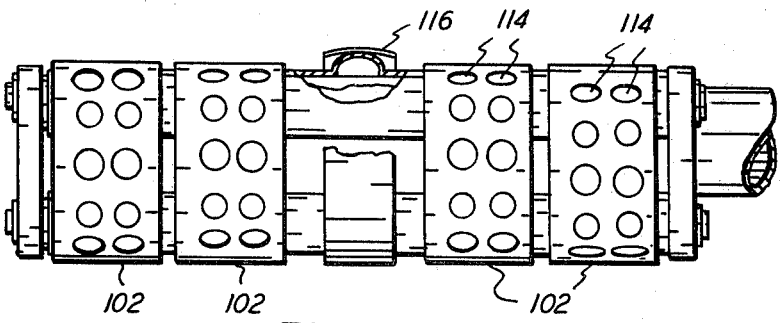
FIG. 6 is an elevational view, partially in section, illustrating the vacuum feed belts of the FIG. 2 sheet separator and feeder.
Figure 7:
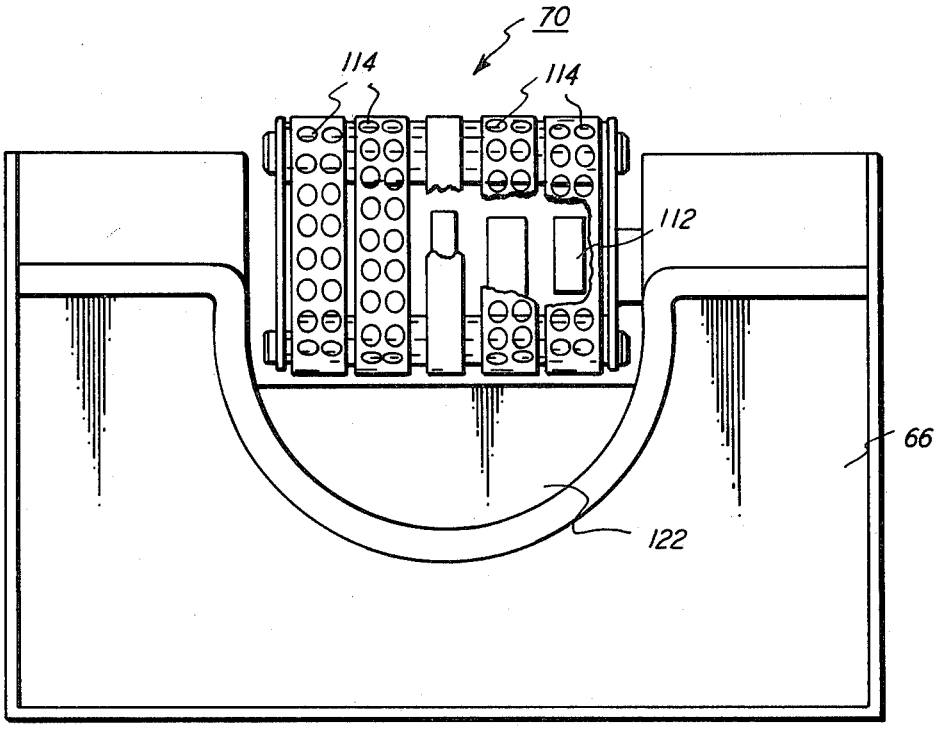
FIG. 7 is a plan view of the document tray and feed belts of the FIG. 1 document handler.

Referring more particularly to FIGS. 3, 6, and 7 wherein the separator feeder of document handling unit 16 is more clearly illustrated, there is disclosed a plurality of feed belts 102 supported for movement on feed belt rollers 104, 106, and 108. Spaced interiorally of belt 102 is vacuum plenum 110 having openings 112 in communication with perforations 114 in belts 102 to provide a vacuum for pulling the bottom documents onto belt 102. As shown in FIG. 6, vacuum plenum 110 includes a raised portion 116 beneath the center belt so that upon capture of the bottom document of the stack against belts 102, a center corrugation will be produced therein. In this way, the bottommost document is separated from the remainder of the documents of the stack. Air knife 74 has a pressurized air plenum 118 coupled to blower 100 for receiving a flow of pressurized air therein. Air jet opening 120 is provided in the walls of plenum 118 to inject air between the document pulled down against the feed belt and the remainder of the stack of documents thereabove. This provides an air cushion or bearing between the stack and the bottom document to minimize the frictional forces necessary for removing the bottom document from the stack. The friction between the bottom sheet and the stack is controlled by the pressure of the air flowing therebetween. The air pressure is regulated by the input pressure provided by blower 100. Blower 100 is controlled by controller 24. Controller 24 adjusts the air flow rate of blower 100 to correspond to a preselected level so as to maintain the stack of original documents spaced from the bottommost original document at a preselected gap. In this way, friction between the bottommost document at the remainder of the stack is mimimized.

With continued reference to FIGS. 2, 3 and 7, document tray 66 has a depressed portion or pocket 122 having a generally parabolic outline behind the feed belt assembly. This pocket receives the bottom document being pulled down onto the feed belt assembly forming the corrugations previously mentioned. In addition, the vacuum is applied over the area of the pocket with an air seal between the bottom document occurring at the parabolic edges of the pocket. The air seal maximizes the vacuum force over the area of the pocket thus helping to pull the document onto the feed belt assembly. Finally, the parabolic pocket forms a high pressure seal between the bottommost document and the remainder of the stack. This high pressure seal is achieved by supporting a major portion of the stack weight on the edge regions of the pocket. The seal serves to reliably convert the velocity energy of the air knife flow into a lifting pressure over the pocket area.

In order to increase the efficiency of the system, the stack tray is provided with a rearward tilt as shown in FIGS. 2 and 3. When flotation air is provided under a stack or between the bottommost document and the remainder of the stack, gravity will allow the documents to settle or float back against the rear tray wall. Thus, the document being removed is pulled uphill while gravity helps hold the remainder of the documents back, helping to prevent misfeeds.

Figure 4:
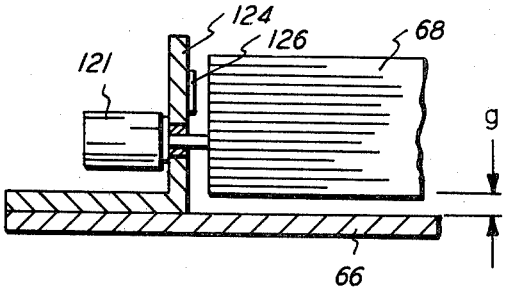
FIG. 4 is a fragmentary, elevational view showing one embodiment of the structure for detecting the gap between the stack of sheets and support tray.

Turning now to FIG. 4, there is shown one embodiment for inferring a friction, as measured by the presence or absence of the gap between the stack of documents and the tray. With the air knife energized and the vacuum applied to belts 102 de-energized, solenoid 121 is energized to move the stack away from rear wall 124 of tray 66. Solenoid 121 pushes the trail edge of stack 68 away from wall 124 a distance ranging from 0.025 cm to 0.05 cm. Thereafter, solenoid 121 is de-energized. Stack 68, if supported by air over gap "g" will move in a rearwardly direction contacting sensor 126. Preferably, sensor 126 is a piezoelectric pickup. Sensor 126 develops an electrical output signal which is processed by controller 24. Controller 24 compares by the time delay between the stack of original documents recontacting sensor 126 and the retraction time of solenoid 121. This time delay is a measure presence or absence of a gap between the stack and tray. If the stack of original documents does not return to contact sensor 126, blower 100 is regulated to increase the flow rate to air knife 74 so as to raise the pressure in gap "g". An alternative embodiment is depicted in FIG. 5.

Figure 5:
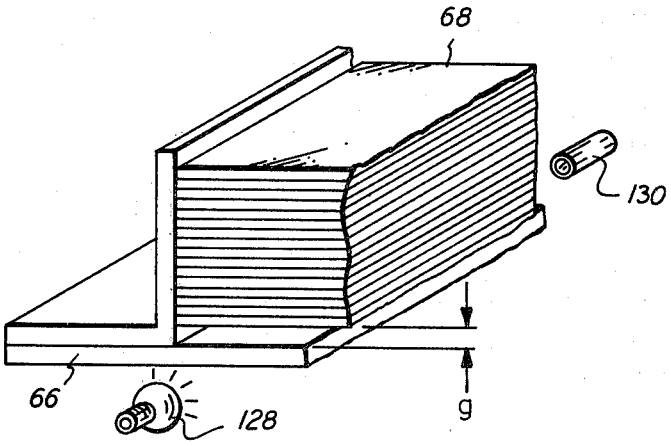
FIG. 5 is a fragmentary perspective view depicting another embodiment of the structure for detecting the gap between the stack of sheets and support tray.

Referring now to FIG. 5, the vacuum applied to belts 102 is once again de-energized. Air flowing from air knife 74 passes between the stack of documents 68 and tray 66. Light source 128 transmits light rays between stack 68 and tray 66, i.e. through gap "g". The intensity of the light rays transmitted through gap "g" is detected by sensor 130. Preferably, sensor 130 is a photodiode. The output from photodiode 130 is transmitted to controller 24 which regulates the air flow from blower 100 and, in turn, the air flow from air knife 74 and the pressure between stack 68 and tray 66.

Figure 8:
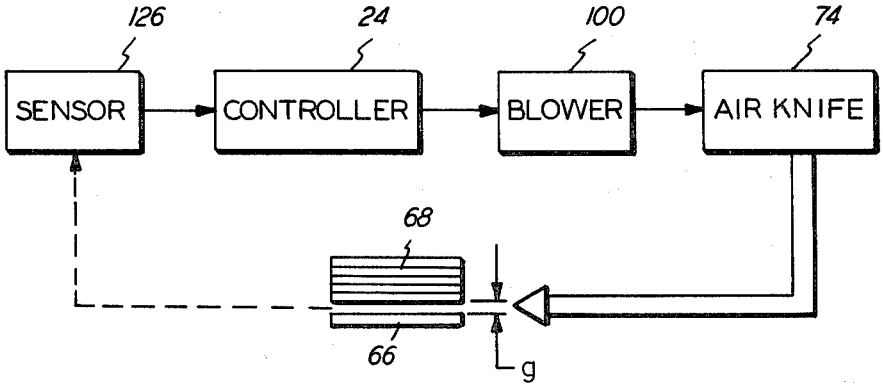
FIG. 8 is a block diagram of the control scheme for regulating the pressure of the fluid flowing between the stack and support tray.

Turning now to FIG. 8, there is shown the control system for minimizing friction between the stack of original documents and the bottommost document. In this case, sensor 126 will be employed for illustrative purposes. However, one skilled in the art will realize that sensor 130 could also be readily utilized with no change in the control scheme. As shown thereat, blower 100 furnished a supply of pressurized air to air knife 74. Air knife 74 directs the flow of air between stack 68 and tray 66 in gap "g". Sensor 126 detects gap "g" and transmits an electrical output signal to controller 24. Controller 24 regulates blower 100 to control the pressure of air flowing to air knife 74. In this way, gap "g" is controlled to a pre-selected level. After blower 100 is adjusted to the desired flow rate, sensor 126 is de-energized. In this case, solenoid 121 would also remain de-energized. At this time, the vacuum applied to belt 102 is re-energized causing the bottommost sheet to be drawn into contact therewith and spaced from stack 68. Air knife 74 now directs a flow of air between the bottommost document and the remainder of the documents of stack 68. In this way, the remainder of the documents of stack 68 are moved away from the bottommost sheet. This improves the separation and feeding of successive bottommost sheets from the stack thereof by reducing friction therebetween.

In recapitulation, it is clear that the document handling unit of the present invention automatically controls the pressure between the stack and support tray. This significantly reduces the friction during sheet separation and feeding.

It is, therefore, evident that there has been provided in accordance with the present invention a document separating and feeding apparatus which fully satisfies the aims and advantages hereinbefore set forth. While this invention has been described in conjunction with various embodiments thereof, it is evident that many alternatives, modifications and variations will be apparent to those skilled in the art. Accordingly, it is intended to embrace all such alternatives, modifications, and variations as fall within the spirit and broad scope of the appended claims.

What is claimed is:

1. An apparatus for separating and feeding sheets, in seriatim, from a stack, including:

means for supporting a stack of sheets;

means for directing a flow of pressurized fluid between the stack and said supporting means;

means for moving the stack against the influence of gravity from a first position to a second position and measuring the time for the stack to return to the first position from the second position under the influence of gravity; and means, responsive to the measured time, for controlling said directing means to regulate the pressure of the fluid flowing between said supporting means and the stack.

2. An apparatus according to claim 1, further including:

means for feeding an outermost sheet from the stack; and means for drawing the outermost sheet of the stack into contact with said feeding means.

3. An apparatus according to claim 2, wherein said directing means directs the flow of pressurized fluid against the lead edge of the outermost sheet of the stack to separate the outermost sheet of the stack from the remainder of the sheets of the stack and to reduce the frictional forces between the outermost sheet and the remainder of the stack.

4. An apparatus for separating and feeding sheets, in seriatim, from a stack, including:

means for supporting a stack of sheets;

means for directing a flow of pressurized fluid between the stack and said supporting means to create a gap between said stack and said supporting means;

means for directing light rays between the stack and said supporting means in the gap;

means of sensing the light rays transmitted through the gap; and means, responsive to the sensed light rays, for controlling said directing means to regulate the pressure of the fluid flowing between said supporting means and the stack.

5. An apparatus according to claim 2, wherein said supporting means includes a tray.

6. An apparatus according to claim 5, wherein said feeding means includes frictional feed means positioned below said tray and the bottom sheet of the stack.

7. An apparatus according to claim 6, wherein said drawing means includes:

a vacuum plenum associated with said frictional feed means, said plenum having openings therein facing the bottom sheet of the stack; and means for lowering the air pressure in said plenum below atmospheric pressure causing the bottom sheet of the stack to be drawn into contact with and acquired by said frictional feed means for separation and forwarding of the bottom sheet from the stack.

8. An apparatus according to claim 7, wherein said directing means includes an air knife.

9. An apparatus according to claim 8, wherein a portion of said frictional feed means is disposed above the remainder of said frictional feed means so as to form corrugations in the bottom sheet being drawn into contact therewith.

10. An apparatus according to claim 9, wherein said plenum includes a portion thereof extending above the remainder of the top surface of said plenum so that the extended portion of said plenum causes corrugations to be formed in the bottom sheet being drawn toward said plenum.

11. An apparatus according to claim 10, wherein said frictional feed means includes a plurality of feed belts, said plenum means being disposed beneath said belts and having openings therein in communication with the spaces between adjacent belts and the apertures in said belts.

12. An apparatus according to claim 11, wherein said plenum includes at least one raised portion disposed beneath at least one of said belts to raise said belt above the plane of the top surface of the remainder of said belts so that a corrugation is formed in the bottom sheet being forced thereagainst.

13. A method of separating and feeding sheets, in seriatim, from a stack, including the steps of:

supporting a stack of sheets on a tray;

directing a flow of pressurized fluid between the stack and the tray;

moving the stack against the influence of gravity from a first position to a second position and measuring the time for the stack to return to the first position from the second position under the influence of gravity; and controlling the pressure of the fluid flowing between the stack and the tray in response to the measured time.

14. A method according to claim 13, further including the steps of:

drawing the outermost sheet of the stack into contact with a frictional feeder in response to the fluid pressure being at a selected value; and energizing the frictional feeder to advance the outermost sheet from the stack.

15. A method according to claim 14, further including the step of redirecting the flow of pressurized fluid against the lead edge of the outermost sheet of the stack to separate the outermost sheet of the stack from the remainder of the sheets of the stack and to reduce the frictional forces between the outermost sheet and the remainder of the stack.

16. A method according to claim 15, further including the step of forming corrugations in the sheet being drawn into contact with the frictional feeder.

17. A method of separating and feeding sheets, in seriatim, from a stack, including the steps of:

supporting a stack of sheets on a tray;

directing a flow of pressurized fluid between the stack and the tray to create a gap between said stack and said tray;

directing light rays between the stack and tray in the gap;

measuring the light rays transmitted through the gap; and controlling the pressure of the fluid flowing between the stack and the tray in response to the measured light rays.

* * * * *